US006273149B1

(12) United States Patent
Dewispelaere et al.

(10) Patent No.: US 6,273,149 B1
(45) Date of Patent: Aug. 14, 2001

(54) PILE FABRIC WOVEN ON A RAPIER AXMINSTER WEAVING MACHINE

(75) Inventors: Andre Dewispelaere, Kortrijk/Marke; Johnny Debaes, Moorslede, both of (BE)

(73) Assignee: N.V. Michel Van de Wiele, Kortrijk/Marke (BE)

( * ) Notice: Subject to any disclaimer, the term of this patent is extended or adjusted under 35 U.S.C. 154(b) by 0 days.

(21) Appl. No.: 09/518,726

(22) Filed: Mar. 3, 2000

(30) Foreign Application Priority Data

Mar. 3, 1999 (BE) ..... 9900146

(51) Int. Cl.[7] ..... D03D 27/06; D03D 39/16; D03D 49/22

(52) U.S. Cl. ..... 139/402; 139/21; 139/391; 139/405

(58) Field of Search ..... 139/405, 21, 391, 139/402

(56) References Cited

U.S. PATENT DOCUMENTS

| | | | | |
|---|---|---|---|---|
| 834,001 | * | 10/1906 | Craddock | 139/402 |
| 3,716,078 | * | 2/1973 | Clark | 139/399 |
| 4,330,907 | * | 5/1982 | Ochiai | 139/391 |
| 5,482,091 | * | 1/1996 | Debaes | 139/391 |

FOREIGN PATENT DOCUMENTS

| | | |
|---|---|---|
| 512962 | 9/1939 | (GB) . |
| 518992 | 3/1940 | (GB) . |
| 791691 | 3/1958 | (GB) . |
| 1082533 | 9/1967 | (GB) . |

* cited by examiner

*Primary Examiner*—Andy Falik
(74) *Attorney, Agent, or Firm*—James Creighton Wray; Meera P. Narasimhan

(57) ABSTRACT

A method for weaving a pile fabric on a rapier Axminster weaving machine is provided in which in the course of successive weft insertion cycles alternately one weft thread (1) alone and two weft threads (2), (3) one above the other are inserted between warp threads (4), (5), (6) so that a backing fabric (9) is woven, while pile threads (7) are so introduced that they are interlaced in the backing fabric (9) according to a three-shot weave by weft threads (1) inserted alone, which extend along the pile side of tension warp threads (6). An Axminster pile fabric is woven with pile formation according to a three-shot weave, while one pile row is formed per two weft insertion cycles. Also, an Axminster pile fabric is provided, in which in successive weft lines, alternately one weft thread (1) alone and two weft threads (2), (3) one above the other are inwoven, and, in which pile threads (7) are interlaced by weft threads (1) alone according to a three-shot weave.

9 Claims, 1 Drawing Sheet

PILE FABRIC WOVEN ON A RAPIER AXMINSTER WEAVING MACHINE

BACKGROUND OF THE INVENTION

This invention relates to a method for weaving a pile fabric on a gripper Axminster weaving machine, whereby weft yarns are brought between binding warp yarns and tension warp yarns so that a backing fabric is woven, while pile threads are so introduced that they are interlaced by weft yarns according to a three-shot weave, so that each pile yarn is passed around a weft thread as a pile tuft with upright pile tuft legs, and while in the course of successive weft insertion cycles alternately one weft yarn alone and two weft yarns one above the other are inserted between the warp yarns.

This invention also relates to an Axminster pile fabric, in particular an Axminster carpet, comprising a backing fabric woven out of weft yarns and warp yarns, in which according to successive weft lines alternately one weft yarn alone, respectively two weft yarns running one above the other are inwoven, and in which pile threads are interlaced by weft yarns according to a three-shot weave, so that each pile yarn is passed around a weft thread as a pile tuft with upright pile tuft legs.

Gripper Axminster weaving machines comprise a shed-forming device and a weft insertion mechanism in order in the course of successive weft insertion cycles in each case to bring a weft yarn into a shed formed between warp yarns, so that a backing fabric is formed. This weft insertion mechanism can be provided with two weft insertion means in order in each operating cycle to be able to insert a respective weft yarn at two different insertion levels.

The weft yarns can be inserted by means of rapiers, by means of a projectile or by a so-called needle insertion. With the latter method a weft yarn is pushed double in loop shape through the shed by means of a long needle with an eye from one fabric side over the entire weaving width. On the other fabric side the weft loop is received by a bobbin which pulls an edging thread through the loop. Subsequently the needle returns to the former fabric side, while one tuft of the inserted loop slides into the eye of the needle. With each needle insertion a weft yarn is therefore provided in the shed running back and forth over the width of the fabric. This weft yarn is represented as two threads in fabric cross-sections.

Since such a back and forth running weft yarn has the same function as a weft yarn which only extends from one fabric side to the other, and is also inserted by one and the same weft insertion means in one and the same weft insertion cycle, this must in the context of this patent application be considered as one weft yarn.

The term "weft yarn" in this patent application, and in particular in the claims attached hereto, therefore refers both to a weft yarn only extending from one fabric side to the other and to such a back and forth running weft yarn.

Furthermore gripper Axminster weaving machines are also provided with a series of upwardly and downwardly rotatable pile rapiers, and for each pile rapier a pile loader in which a number of different pile warp yarns are provided. Each pile rapier can in an upwardly rotated position grip the extremity of one of the pile warp yarns in its pile loader. In the course of its downward rotation the rapier pulls the pile warp yarn out of the pile loader. Subsequently this is automatically cut through by a cutting device so that a well-defined length of the pile warp yarn is taken along by the rapier. This piece of pile warp yarn (called "pile thread" in that which follows) is in the course of the further downward rotation of the rapier brought to the edge of the fabric, and is so brought there in relation to the weft insertion path of a weft insertion means that it is interlaced in the backing fabric by the weft yarn inserted thereafter by that weft insertion means. The pile threads are inwoven in the backing fabric as U-shaped pile tufts, with upright pile tuft legs passed around a weft yarn.

Each pile loader can be brought by means of a jacquard device into a number of different positions, so that in each position the extremity of another pile warp yarn comes into reach of the pile rapier working together therewith. In that manner pile can be formed with a great number of different colors (up to 12), while no dead pile warp yarns have to be inwoven. This results in a particularly low pile yarn consumption.

A weaving method exists, known by the name of "3-shot Corinthian", whereby on a gripper Axminster weaving machine in each weft insertion cycle one weft yarn is inserted between warp yarns, and whereby pile is formed according to a three-shot weave. According to this weaving method a backing fabric is formed in which next to each other alternately one weft yarn and two weft yarns one above the other are inwoven by binding warp yarns. In this backing fabric tension warp yarns extend between the weft yarns inwoven one above the other and along the back of the weft yarns inwoven alone. The pile threads are in each case interlaced by the top weft yarn of the two weft yarns inwoven one above the other. This weaving method produces pile tufts with a good anchorage in the backing fabric and with good upright standing pile tuft legs. Furthermore the pile yarn consumption is minimal since the pile threads are not woven through to the back of the backing fabric.

This weaving method however has the great disadvantage that there are three weft insertion cycles in order to form one pile tuft row. The productivity of this weaving method is consequently not very high.

This "3-shot Corinthian" weave have never been woven with double weft insertion because of the following list of reasons.

From GB512962 an Axminster weaving machine is known which is provided for alternately inserting one and two weft yarns, with which this weaving method could be applied with a high productivity. A number of other problems and disadvantages are however not solved with this.

The required weaving machine has two weft insertion means with which in the course of the same weft insertion cycle two weft yarns have to be inserted. The pile rapiers have to hold the pile threads between these two weft insertion paths during the double weft insertion without moreover impeding the movements of the weft insertion means. This is not possible with pile rapiers with the usual shape and dimensions.

Another problem lies in the fact that, even were pile rapiers provided with limited dimensions of the pile rapier jaws, the weft insertion paths would still have to be placed rather far from each other in order that the pile rapier jaws would not impede the movement of the weft insertion means. This would mean that a rather large shed has to be formed between the warp yarns. Because of this no high weaving speed would be able to be achieved.

A problem could also further occur during the beating-up of the two weft yarns located one above the other. During the beating-up these weft yarns could be pulled against the pile rapier jaws by the binding warp yarns. In the course of the beating-up the pile threads held by the pile rapier jaws could become caught between these two weft yarns, with the result that they are torn out of the pile rapier jaws.

In order to be able to weave fabrics with a rather short pile the points of the pile rapier jaws must furthermore be as close as possible to the holding fingers on the fabric edge. In the course of the beating-up of the two weft yarns inserted one above the other the bottom weft yarn could push the pile rapier jaws upward, which could result in the formation of pile tufts with pile tuft legs of unequal length—so-called J-tufts.

Weaving methods are known whereby pile tufts are formed according to a two-shot weave and whereby one weft yarn is inserted per cycle. According to these methods one pile tuft row is therefore formed per two weft insertion cycles, but with the thus obtained fabrics the good pile anchorage is not achieved which is obtained with fabrics with pile formation according to a three-shot weave.

The purpose of this invention is to provide a weaving method with the properties mentioned in the first paragraph of this specification, which can be implemented without any problem on the existing gripper Axminster weaving machines at high weaving speeds, and which produce fabrics with a proper pile formation according to a three-shot weave, but whereby one pile tuft row can be formed per two weft insertion cycles.

This purpose is according to this invention achieved because of the fact that with the weaving method described in the first paragraph of this specification, each pile thread is inwoven by a weft yarn inserted alone, which extends along the pile side of the tension warp yarns.

In the course of the weft insertion cycles in which two weft yarns are inserted one above the other the pile rapiers must not apply any pile threads to the fabric edge. The pile rapiers can therefore remain above the weft insertion paths. This means that these weft insertion paths can lie close to each other, so that the shed formed between the warp yarns can be kept relative small. Because of this high weaving speeds can be achieved.

In the course of the weft insertion cycles in which one weft yarn is inserted alone the pile rapiers must provide pile threads in an inweaving position near to the fabric edge. Since only one weft yarn is inserted the pile rapiers must moreover only leave one weft insertion path free. Because of this the pile rapier jaws can be implemented with a normal shape and dimensions. Since below the weft yarn which interlaces the pile threads no second weft yarn has to be beaten up, there is also no danger that the pile threads held by the pile rapiers are torn out of the pile rapiers in the course of the beating-up of this weft yarn, or that the pile rapier jaws are pushed upward in the course of the beating-up.

The beating-up of the weft yarn which interlaces the pile threads therefore occurs in exactly the same circumstances, and therefore equally without any problem, as with a weaving method whereby one weft yarn is inserted per weft insertion cycle on a gripper Axminster weaving machine.

Furthermore according to this method a fabric is obtained with good upright standing pile tuft legs and with a good anchorage of the pile tufts in the backing fabric.

Because of the fact that the weft yarns inserted alone are inwoven in the backing fabric along the pile side of the tension warp threads, the pile yarn consumption is minimal. Furthermore the positions of the tension warp yarns do not have to be altered in the course of the weaving. These can be kept between the two weft insertion paths. The tension warp weaving frame does not therefore have to be moved.

SUMMARY OF THE INVENTION

The method according to this invention is preferably implemented on a weaving machine with two weft insertion means operating one above the other. In the course of the weft insertion cycles in which one weft yarn is inserted alone, one of the two weft insertion means is then disengaged.

It is moreover most preferable to allow the weft yarns inserted alone in each case to be inserted by the weft insertion means operating at the top level, while the weft insertion means operating at the bottom level is disengaged.

In the course of the weft insertion cycles in which one weft yarn is inserted alone the pile rapiers can be in the weft insertion path of the disengaged bottom weft insertion means.

Preferably sets of two binding warp yarns are also provided so that these binding warp yarns cross each other repeatedly and form successive openings between their crossings in which alternately a weft yarn inserted alone and two weft yarns inserted one above the other extend.

Another object of this invention is an Axminster pile fabric, in particular an Axminster pile fabric manufactured according to the method according to this invention, with the characteristics mentioned in the second paragraph of this specification, of which each pile thread is interlaced by a weft yarn inwoven alone.

When weaving such a fabric one pile tuft row can be woven per two weft insertion cycles, while for weaving the known 3-shot Axminster pile fabrics three weft insertion cycles were necessary in order to obtain one pile tuft row. The fabric according to this invention can therefore be woven with a considerably higher productivity, and therefore with less production costs.

Furthermore this fabric can be woven according to a weaving method which guarantees a problem-free operation of the Axminster weaving machine, and produces Axminster pile fabrics of a very good quality. Among others pile tufts with a good anchorage in the backing fabric and with good upright standing pile legs can be formed.

The pile fabric according to this invention comprises, in a preferred embodiment, tension warp yarns which extend in the backing fabric along the back of the weft yarns inserted alone. Through the inweaving of the weft yarns inserted alone along the pile side of the tension warp yarns this fabric can be woven with a minimum pile yarn consumption.

Each pile thread is preferably interlaced by a single weft yarn which lies on the pile side of the tension warp yarns and is followed by two weft yarns located one above the other, of which one lies on the pile side of the fabric (between two pile rows) and one lies on the back of the fabric, and is not located below a pile row.

Preferably this fabric also comprises sets of two binding warp yarns which cross each other repeatedly and form successive openings between their crossings through which alternately one weft yarn alone, respectively two weft yarns located one above the other extend.

According to a most preferred embodiment the Axminster pile fabric according to this invention is provided on the back with a synthetic material layer, in particular with a latex layer.

Because of the fact that along the back of the single weft yarns, no covering weft yarns extend the pile-tuft-forming pile threads are well accessible to the synthetic material, so that because of this an even better pile anchorage is achieved.

In that which follows a more detailed specification is given of a possible weaving method according to this invention and of the pile fabric manufactured according to this method.

This specification only serves to clarify the invention further, and to specify further properties and distinctive features thereof, and can therefore not be considered as a restriction on the protection claimed for this invention in the claims attached hereto.

BRIEF DESCRIPTION OF THE DRAWINGS

In this specification reference is made by means of reference numbers to the figures attached hereto, of which

DETAILED DESCRIPTION

The weaving method according to this invention is implemented utilizing a gripper Axminster weaving machine with two weft insertion means operating one above the other. These means can be needles, rapiers or projectiles, which are provided in order in the course of the same weft insertion cycle simultaneously to insert a respective weft yarn according to respective weft insertion paths located one above the other.

The weaving machine is further also provided with a known shed-forming mechanism in order to form a shed between the warp yarns (4), (5), (6) provided on the weaving machine. Prior to each weft insertion a shed is formed whereby the various warp yarns are brought to the correct level in relation to the weft insertion paths in order to obtain the desired fabric.

The weaving machine further also comprises a pile rapier mechanism with which cut-off pieces of pile thread (7) can be brought into an inweaving position near to the fabric edge.

On the weaving machine several warp yarn systems are provided, which each comprise two binding warp yarns (4), (5) and one tension warp yarn (6).

Figure 1:
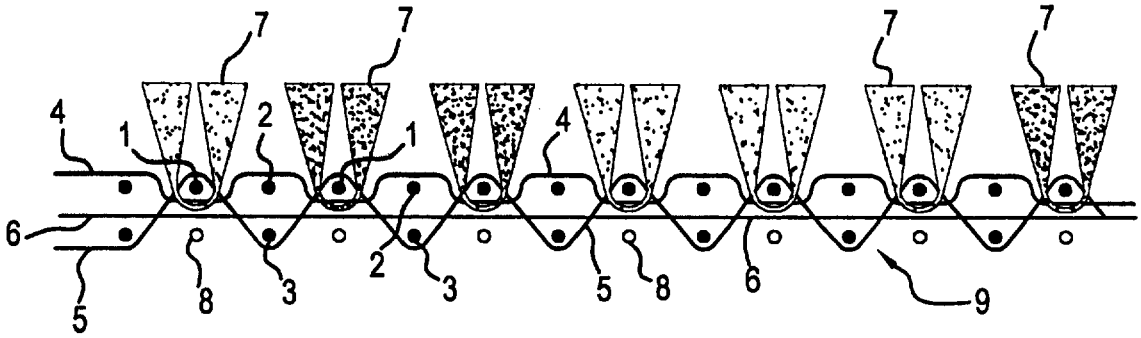
FIG. 1 is a schematic cross-section according to the warp direction of an Axminster pile fabric, in which it is indicated (by reference number 8) in which locations in the fabric no weft yarns have been inserted as a result of disengaging a weft insertion means.
Figure 2:
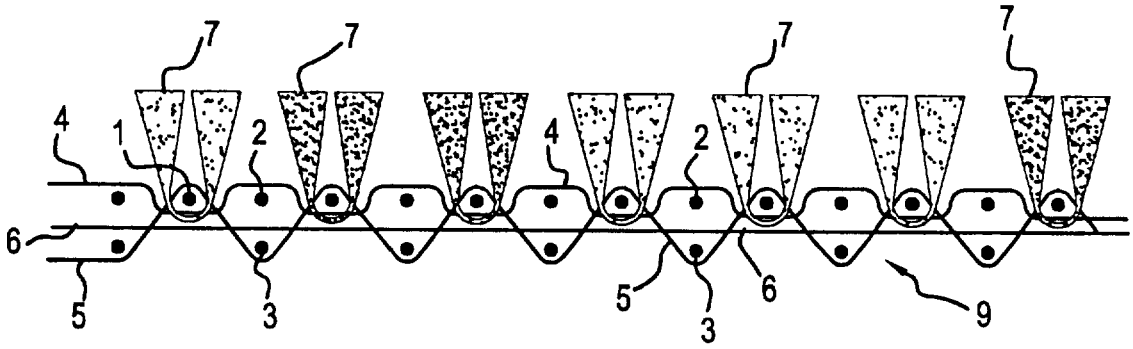
FIG. 2 represents the schematic cross-section from FIG. 1 without indication of the aforesaid locations where no weft yarns have been inserted.

The weft insertion mechanism is operated in order in successive weft insertion cycles alternately to allow only the top weft insertion means to operate, and subsequently to allow both weft insertion means to operate. Therefore alternately one weft yarn (1) alone, and two weft yarns (2), (3) one above the other are inserted. The locations where in the fabric no weft yarn is inserted by disengaging the bottom weft insertion means have been indicated in FIG. 1 by reference number 8.

In each warp yarn system the tension warp thread (6) is in the course of the successive weft insertion cycles held between the two weft insertion paths. The two binding warp yarns (4), (5) are prior to each double weft insertion brought respectively above and below the two weft insertion paths. Prior to each single weft insertion their positions are swapped, so that they form successive openings in which alternately one weft yarn (1) and two weft yarns (2), (3) one above the other are inwoven.

The weft yarns (1), (2), (3) and the warp yarns (4), (5), (6) of the various warp yarn systems in that manner form a backing fabric (9) in which the weft yarns (1) inserted alone are inwoven above the tension warp yarns (6) and in which the weft yarns (2), (3) inserted one above the other are inwoven respectively above and below the tension warp yarns (6) by the binding warp yarns (4), (5).

Prior to each single weft insertion the pile rapiers bring pile threads (7) into an inweaving position near to the fabric edge. Because of the fact that the bottom weft insertion means is disengaged during this cycle the pile rapiers can be placed on the bottom weft insertion path. The pile threads (7) are passed as pile tufts in U-shape around the weft yarns (1) inserted alone. Pile tufts are formed according to a three-shot weave, while one row of pile tufts is formed per two weft insertion cycles.

This weaving method enables pile fabrics of a good quality with a high productivity and with a low pile yarn consumption to be woven on gripper Axminster weaving machines with pile rapiers whose jaws can have a normal shape and dimensions.

What is claimed is:

1. Method for weaving a pile fabric on a rapier Axminster weaving machine comprising bringing plural weft threads between binding warp threads and tension warp threads for weaving a backing fabric, introducing pile threads such that the pile threads are interlaced by the weft threads according to a three-shot weave, wherein each pile thread is passed around one weft thread as a pile tuft with upright pile legs, inserting in successive weft insertion cycles alternately the one weft thread alone and two of the plural weft threads one above another between the warp threads, and weaving in each pile thread by a weft thread inserted alone which extends along a pile side of the tension warp threads.

2. The method of claim 1, further comprising operating two weft insertion means on the weaving machine one above another, and disengaging one of the two weft insertion means during weft insertion cycles when one weft thread is inserted alone.

3. The method of claim 2, wherein the inserting one weft thread alone comprises inserting in each case the weft thread by a weft insertion means operating at a top level and disengaging the other weft insertion means operating at a bottom level.

4. The method of claim 1, further comprising providing sets of two binding warp threads crossing each other repeatedly and forming successive openings between the crossings, and extending alternatively the one weft thread alone and the two weft threads one above another.

5. An Axminster pile fabric comprising a backing fabric woven out of plural weft threads and warp threads having successive weft lines alternating between one weft thread alone and two of the plural weft threads running one above another, said backing fabric having pile threads interlaced by the weft threads according to a three-shot weave, such that each pile thread passes around the one weft thread as a pile tuft with upright pile legs, and each pile thread being interlaced by the one weft thread inserted alone.

6. The fabric of claim 5, further comprising tension warp threads in the pile fabric extending in the backing fabric along backs of the weft threads inserted alone.

7. The fabric of claim 5, further comprising sets of two binding warp threads crossing each other repeatedly and forming successive openings between crossings, and having alternate extensions of the one weft thread alone and the two weft threads one above another.

8. The fabric of claim 5, further comprising a synthetic material layer on a back side of the fabric.

9. The fabric of claim 8, wherein the synthetic material layer is a latex layer.

* * * * *